US012421750B2

(12) United States Patent
Hermans et al.

(10) Patent No.: US 12,421,750 B2
(45) Date of Patent: Sep. 23, 2025

(54) FOUNDATION DEVICE

(71) Applicant: IP RESERVE PTY LTD, Crestmead (AU)

(72) Inventors: Ty Hermans, Ocean View (AU); Mayer Jung, Milton (AU)

(73) Assignee: IP RESERVE PTY LTD, Crestmead (AU)

( * ) Notice: Subject to any disclaimer, the term of this patent is extended or adjusted under 35 U.S.C. 154(b) by 130 days.

(21) Appl. No.: 18/033,206

(22) PCT Filed: Sep. 29, 2021

(86) PCT No.: PCT/AU2021/051133

§ 371 (c)(1),
(2) Date: Apr. 21, 2023

(87) PCT Pub. No.: WO2022/087649

PCT Pub. Date: May 5, 2022

(65) Prior Publication Data

US 2023/0392406 A1 Dec. 7, 2023

(30) Foreign Application Priority Data

Oct. 26, 2020 (AU) ..... 2020903866
Aug. 10, 2021 (AU) ..... 2021215130

(51) Int. Cl.
*E04H 12/22* (2006.01)
*E02D 27/01* (2006.01)
(Continued)

(52) U.S. Cl.
CPC ..... *E04H 12/2238* (2013.01); *E02D 27/02* (2013.01); *E02D 27/42* (2013.01);
(Continued)

(58) Field of Classification Search
CPC . E04H 12/2238; E04H 12/2269; E02D 27/02; E02D 27/42; E02D 27/01;
(Continued)

(56) References Cited

U.S. PATENT DOCUMENTS 6,345,474 B1 2/2002 Triplett
8,931,977 B2 * 1/2015 Connors ..... F16L 1/028 405/184.4

(Continued)

FOREIGN PATENT DOCUMENTS

AU 2014203401 B2 1/2015
CA 2922036 A1 8/2017

OTHER PUBLICATIONS

Pier Blocks [retrieved on Jul. 12, 2021]; <URL: https://web.archive.org/web/; 20190325220320/http://www.centurygrp.com:80/Products/ Concrete-Steps/Post-Piers>published on Mar. 25, 2019 as per Wayback Machine whole document.

(Continued)

*Primary Examiner* — Omar F Hijaz
(74) *Attorney, Agent, or Firm* — Dilworth & Barrese, LLP.; Michael J. Musella, Esq.

(57) ABSTRACT

A foundation device able to support two different sized posts. The foundation device comprising a platform; a base located below the platform with the base being connected to the platform by an outer support wall; an inner support wall extending upwardly from the platform, the inner support wall being separated into four inner wall sections that define a first beam channel and a second beam channel; and a post recess centrally located within the platform, a floor of the post recess being located lower than that of the platform.

16 Claims, 10 Drawing Sheets

(51) Int. Cl.
*E02D 27/02* (2006.01)
*E02D 27/42* (2006.01)

(52) U.S. Cl.
CPC ..... *E02D 27/01* (2013.01); *E04H 12/22* (2013.01); *E04H 12/2261* (2013.01); *E04H 12/2269* (2013.01); *E04H 12/2284* (2013.01); *E04H 12/2292* (2013.01)

(58) Field of Classification Search
CPC ... E02D 2200/1692; E02D 5/72; E04B 1/003; E04C 3/00
See application file for complete search history.

(56) References Cited

U.S. PATENT DOCUMENTS

| | | | | |
|---|---|---|---|---|
| D737,665 | S * | 9/2015 | Kwakkel | D8/356 |
| 11,248,390 | B1 * | 2/2022 | Queen | E04H 12/2238 |
| 2005/0072105 | A1 * | 4/2005 | Hoffman | E02D 27/01 52/698 |
| 2007/0187564 | A1 * | 8/2007 | McGuire | E04H 12/2261 248/346.5 |

OTHER PUBLICATIONS

Meet TuffBlock—The Revolutionary & Highly Engineered Polymer Alternative to Concrete Deck Blocks [retrieved on Jul. 12, 2021]; <URL: https://www.youtube.com/watch?v=01pj4UkZrCU> published on Apr. 1, 2020 by BuildTuff. 0:21, 0:35.

* cited by examiner

FOUNDATION DEVICE

FIELD OF THE INVENTION

This invention relates to a foundation device. In particular, the invention relates to a foundation device that is able to provide support for posts and beams for the construction of decks and, therefore, will be described in this context. However, it should be appreciated that the foundation device may be used for other purposes.

BACKGROUND OF THE INVENTION

Foundation blocks formed from concrete have been used to provide support for beams and posts for above ground or on the ground foundations. Although these blocks provide support for a post, or a beam (e.g. a bearer or joist), they are normally limited to providing for only one size of post or beam. Due to the limitations of the mechanical properties of concrete, concrete foundation blocks must have a minimum height which normally requires that the height of the floor above the joists is at least two standard size steps above the ground. If the ground is sloping, then the shortest support post for the structure supported by the concrete foundation blocks must be at least the minimum height. Hence, a deck that is constructed using concrete foundations block is spaced substantially above the ground surface.

To address this issue, a plastic injection moulded foundation device was created by the applicant and is described in Australian Patent No. 2014203401. The foundation device, described in Australian Patent No. 2014203401, is able to be used to support either a post or beam. The foundation device is of a substantially lower profile allowing decks to be built substantially lower to the ground than traditional concrete foundation blocks. It is lightweight for both transportation and use, and able to support substantial loads. Accordingly, it has become a popular replacement for concrete foundation blocks.

Although the foundation device disclosed in 2014203401 is a popular product, different sized foundation devices must be produced to cater for different sized posts. This requires a business to hold stock in different sizes to accommodate customer requirements. This is undesirable due to both storage and capital requirements. Further, although the foundation block disclosed in Australian Patent No. 2014203401 is nestable, it still takes up more space than is desired.

In this specification, terms such as upward, downward, horizontal and vertical, and their grammatical derivatives, are used to describe the invention in its normal orientation and are not to be construed to limit the invention to any particular orientation.

OBJECT OF THE INVENTION

It is an object of the invention to overcome and/or alleviate the abovementioned problems and/or provide the consumer with a useful or commercial choice.

SUMMARY OF THE INVENTION

In one form, although not necessarily the only or broadest form, the invention resides in a foundation device able to support two different sized posts, the foundation device comprising:

a platform;

a base located below the platform, the base connected to the platform by an outer support wall;

an inner support wall extending upwardly from the platform, the inner support wall being separated into four inner wall sections that define a first beam channel and a second beam channel; and a post recess centrally located within the platform, a floor of the post recess being located lower than that of the platform.

The platform is typically cruciate in shape when viewed in plan. The platform may include a series of raised projections located on its surface. The projections may be substantially circular or rectangular in shape. The platform may include indicia to indicate the correct orientation of a post.

The base is normally substantially planar. An outer perimeter of the base may be of any suitable shape such a circular, octagonal, hexagonal, square or rectangular when viewed in plan. Preferably, the base is square or octagonal.

The inner support wall may be used to hold beams and posts. Each of the inner support wall sections may include a series of support ribs. The support ribs are normally connected to the platform. The support ribs may be tapered with a widest portion of the support ribs being located adjacent the platform. Typically each of the inner wall sections is of the same shape and may have the same number of support ribs.

Each of the inner support wall sections include two straight portions that are interconnected by a curved portion. The straight portion of the inner support wall sections may be used to support a beam. Support ribs on the straight portions of the inner wall sections may contact the beam. Support ribs on curved portions of the inner support wall sections may be used to support a post. One or more support ribs located on the curved portion may contact the post.

A straight portion of one wall section may lie in the same plane as a straight portion of an adjacent wall section.

The first beam channel and the second beam channel may be transverse with respect to each other. Normally the first beam channel and the second beam channel are at substantially right angles with respect to each other.

The first beam channel and the second beam channel may be of the same width. Preferably the first beam channel and the second beam channel are of a different width.

Both the first beam channel and the second beam channel may be effectively tapered with the first beam channel and the second beam channel being at its narrowest adjacent the platform.

The outer support wall may extend continuously around the platform. Normally the outer support wall may be connected to the edges of the platform. The edges of the platform may be located adjacent the ends of the first beam channel and the second beam channel.

Generally, the outer support wall is concave. That is, the outer support wall is curved inwardly as it extends from the base to the platform.

The outer support wall may be connected to the inner support wall sections to form support members. Portions of the outer walls that form the support members may be substantially accurate in shape. Normally, the portions of the outers walls that form the support members are substantially concave in shape.

An underside of the support members may be substantially hollow. That is, a nesting cavity may be located within the support member.

The post recess may include a series of post ribs that are used to support a post. The post ribs are normally connected to the floor. The post ribs may be tapered with a widest portion of the located adjacent the floor. Normally, the post ribs being located adjacent the floor.

The floor is typically planar. The height of the floor is normally substantially the same height as the base.

A series of strengthening members may be form part of the underside of the base, the outer support wall and/or the post recess. A series of structs may connect the post recess to the outer wall.

Further features of the invention will become apparent from the detailed description below.

BRIEF DESCRIPTION OF THE DRAWINGS

Embodiments of the invention will be described, by way of example only, with reference to the accompanying figures in which.

DETAILED DESCRIPTION OF THE PREFERRED EMBODIMENTS

Figure 1:
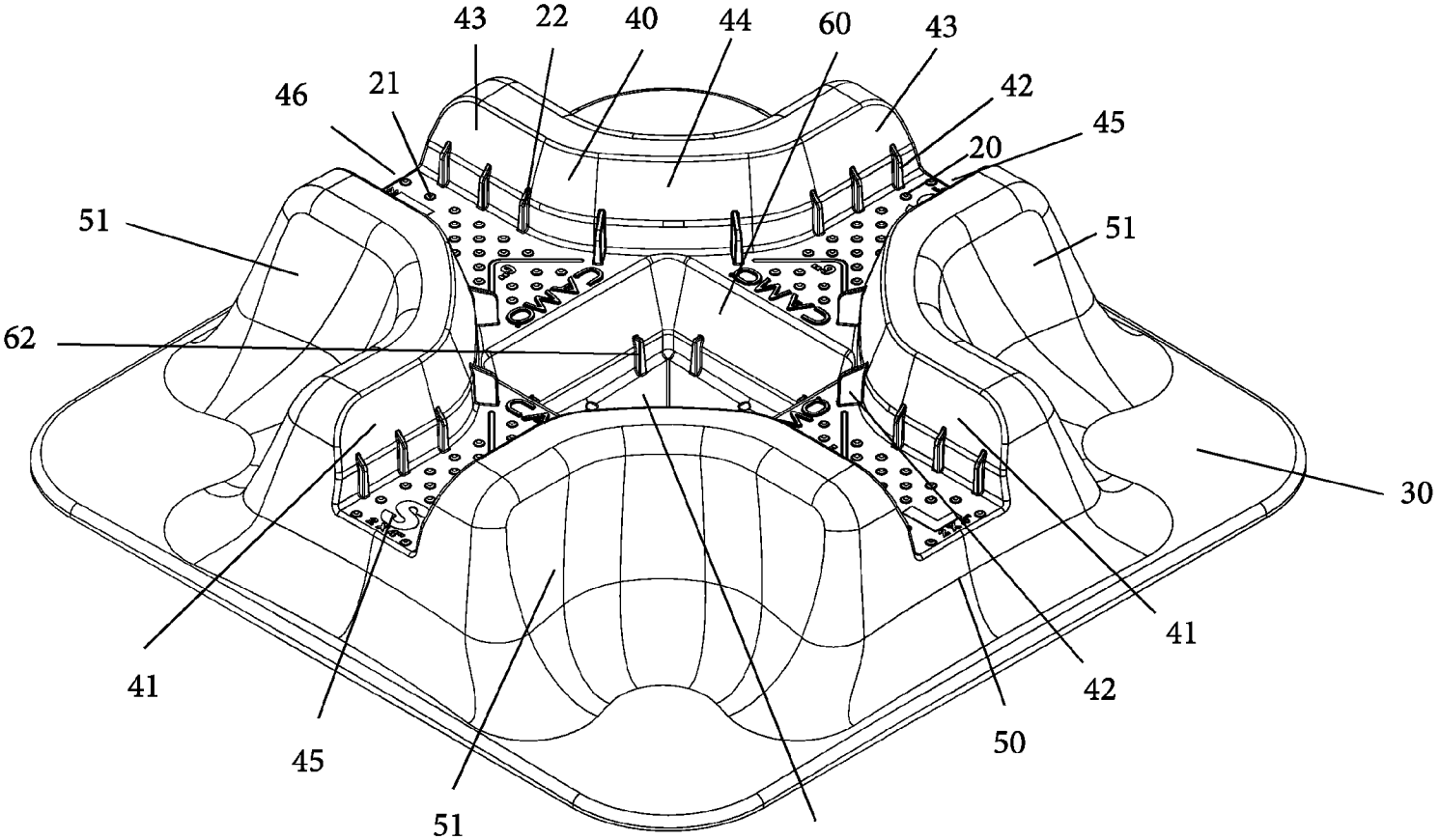
FIG. 1 is a top perspective view of a foundation device according to a first embodiment of the invention.
Figure 2:
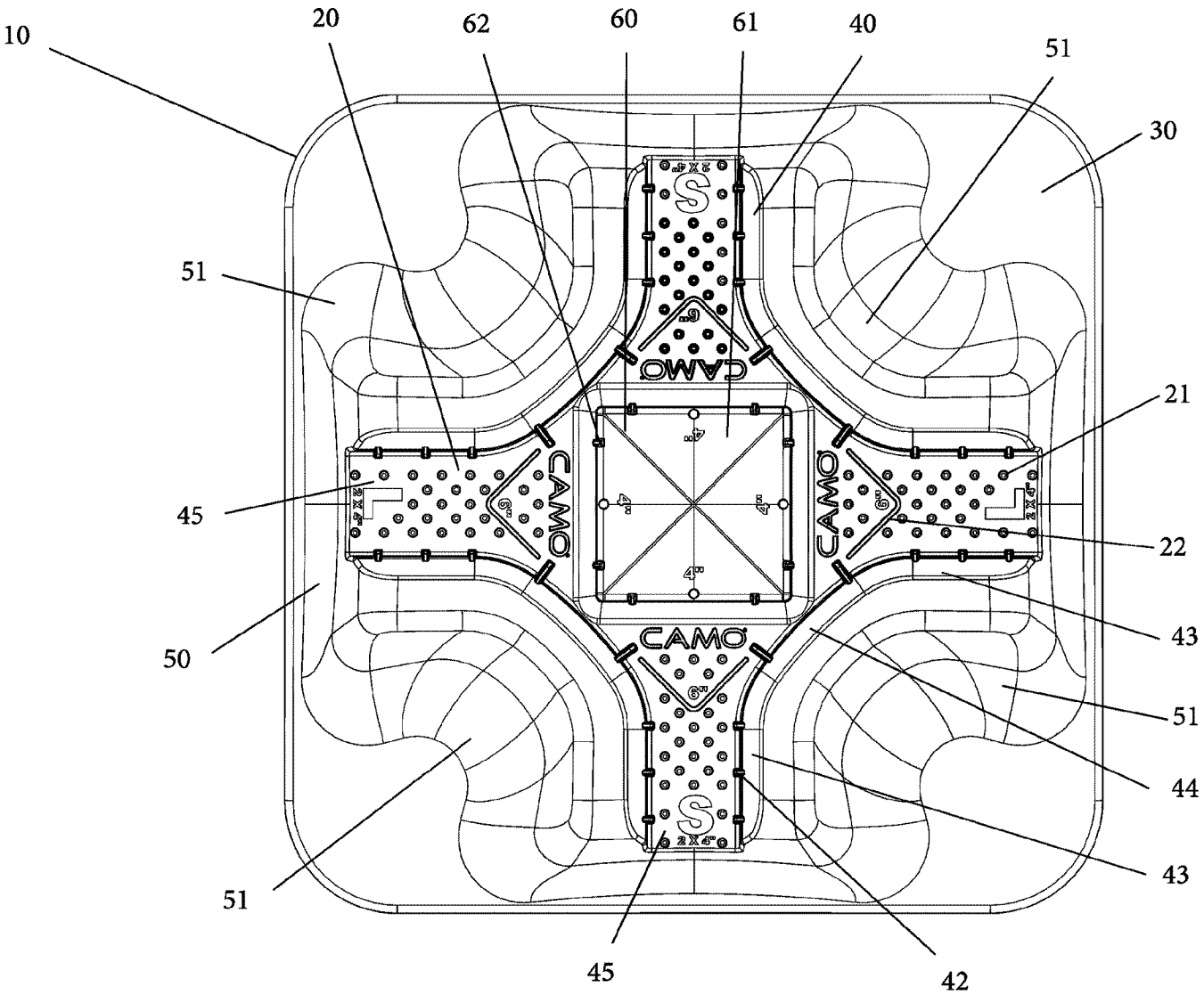
FIG. 2 is a top view of the foundation device as shown in FIG. 1.
Figure 3:
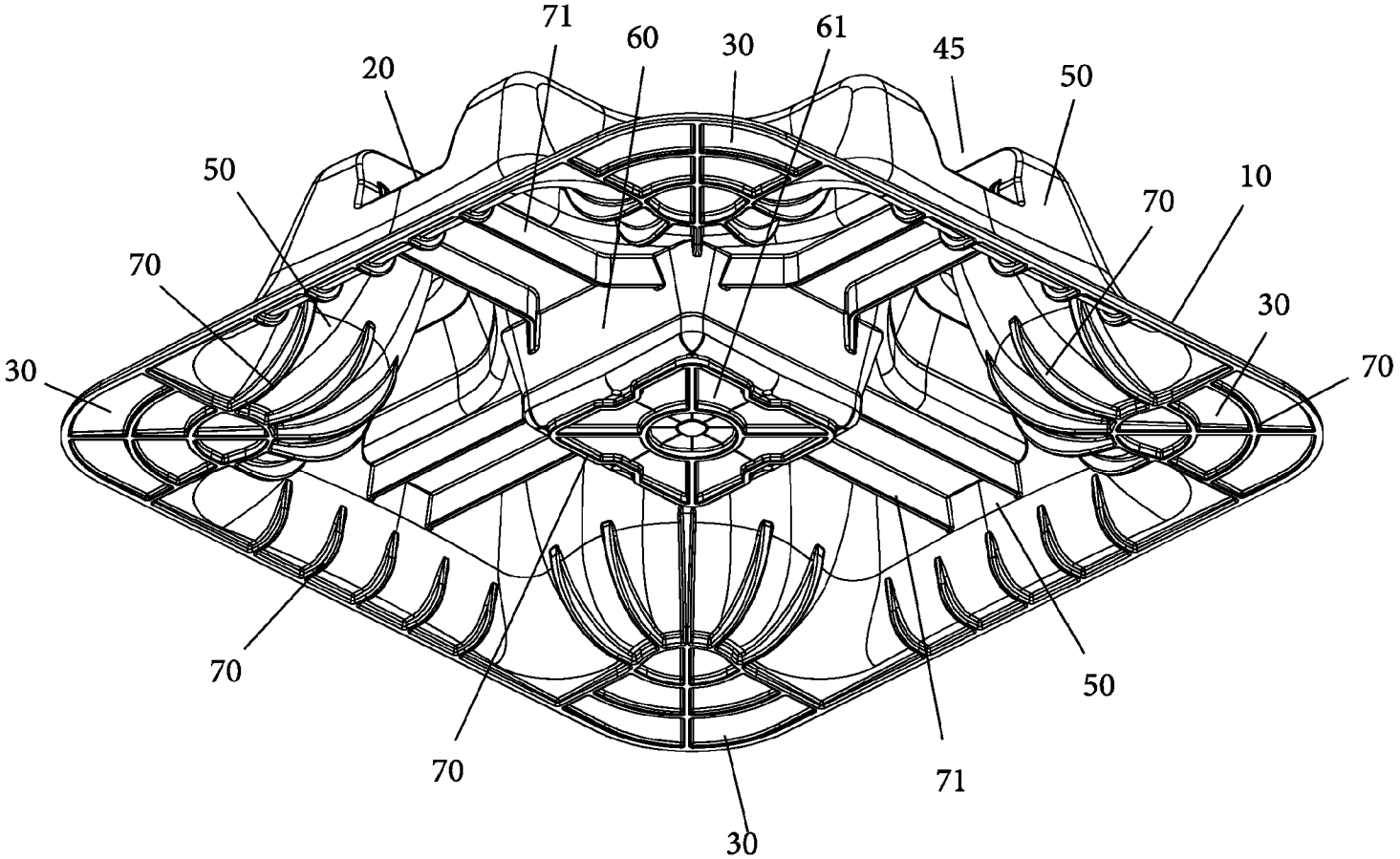
FIG. 3 is an underside perspective view of the foundation device as shown in FIG. 1.
Figure 4:
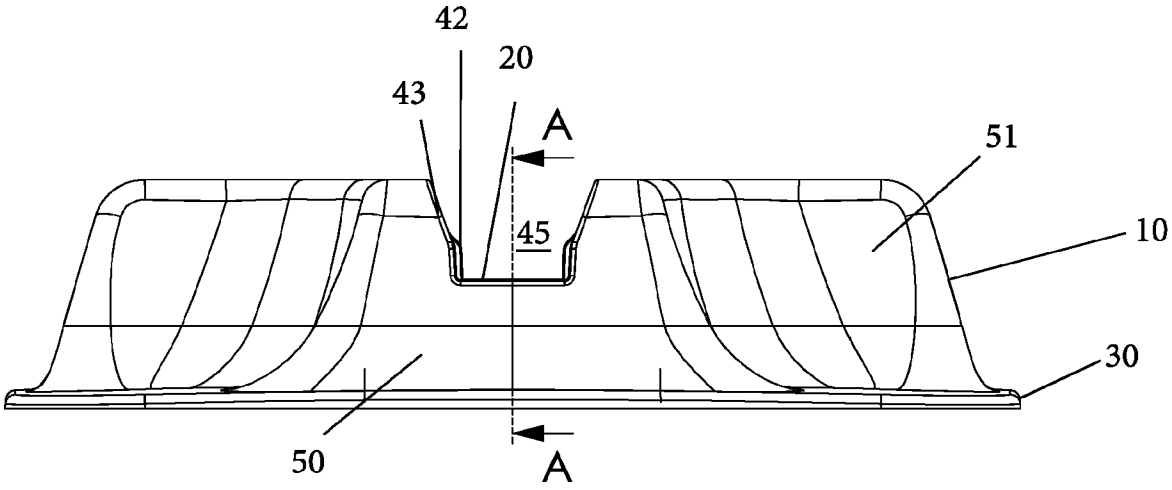
FIG. 4 is a side view of the foundation device as shown in FIG. 1.
Figure 5:
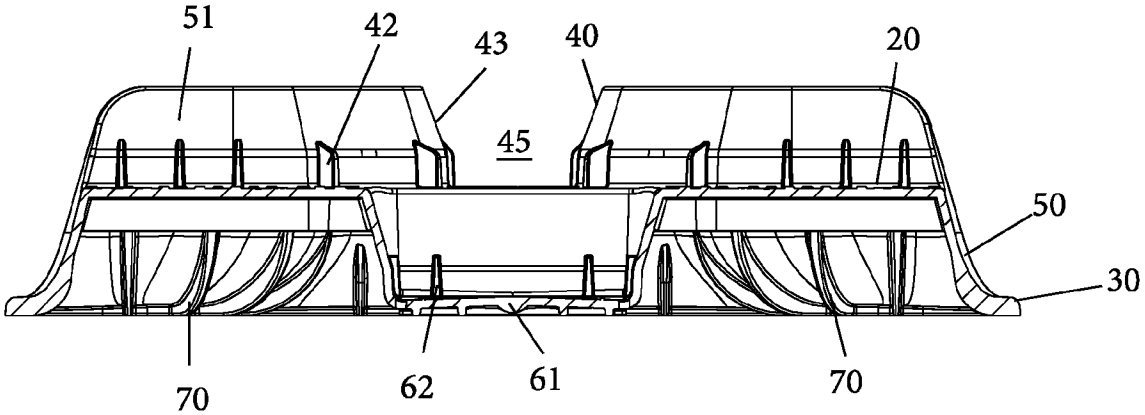
FIG. 5 is a side sectional view along line A-A of the foundation device as shown in FIG. 1.

FIGS. 1 to 5 shows a foundation device 10 that is utilised to provide an on or above ground support for both posts and beams. The foundation device 10 is primarily used for the construction of decks, but it should be appreciated that the foundation device 10 may be used for other types of construction.

The foundation device 10 is integrally formed and made from an injection moulded plastic. There are many types of suitable plastics, but the most preferable is polypropylene. The foundation device 10 includes a platform 20, a base 30, an inner support wall 40, an outer support wall 50 and a post recess 60.

The platform 20 is used to support both posts and beams. The platform 20 is substantially planar and is essentially cross-shaped when viewed in plan. A series of circular projections 21 are located on the surface of the platform 20. These circular projections 21 are used to both grip a post or a beam and provide a water egress pathway to assist in preventing water damage to the post or beam. Indicia, in the form of chevrons 22, are located on the platform 20 to show the correct orientation of a post.

The base 30 is used as a foot to contact the ground surface that the construction is formed upon. An outer perimeter of the base 30 is square in shape. The base 30 is substantially planar to provide a large surface area contact. A series of strengthening members 70 are located on the underside of the base 30 to assist with rigidity.

The inner support wall 40 is used to hold beams and posts as well as position the beams and posts on the correct location on the platform 20. The inner support wall 40 is split into four inner support wall sections 41. Each inner support wall section 41 has two straight portions 43 that are interconnected by a curved portion. Each of the inner support wall 40 sections includes a series of support ribs 42 that are located on both the straight portions 43 and the curved portions 44. The support ribs 42 are tapered with a widest portion of the support ribs 42 connected to the platform 20. The support ribs 42 extend perpendicular with respect to the straight portions 43 and curved portions 44.

The straight portions 43 of the inner support wall 40 sections define a first beam channel 45 and a second beam channel 46. The first beam channel 45 and second beam channel 46 are used to located beams. Accordingly, the straight portions 43 on adjacent inner support wall sections 41 are in alignment and hence lie in the same plane. The first beam channel 45 is located perpendicularly with respect to the second beam channel 46. Indicia is located on the platform to indicate which channel is small and which channel is large.

The width of the first beam channel 45 and the width of the second channel are different. This is to cater for the imprecise nature of wooden beams. Further, the tapered support ribs 42 on the straight portions 43 allow for further variations. That is, both the first beam channel 45 and the second beam channel 46 are tapered with the narrowest portion of the first beam channel 45 and the second beam channel 46 being located adjacent the platform 20. The first beam channel 45 allows for beams that have a width of between 35 mm to 41 mm whilst the second beam channel 46 allows for beams that have a width of between 41 mm to 47 mm. It would be appreciated that the width of the channels 45 and 46 can support can be varied and hence the width of the beams that the foundation device 10 can support can be varied.

The outer support wall 50 is connected to both the inner support wall 40 and to edges of the platform 20. The outer support wall 50 is connected to the edges of the platform 20 adjacent to respective ends of the first beam channel 45 and the second beam channel 46. Four support members 51 are formed by the joining of the inner support wall 40 sections and the outer support wall 50. As the inner support wall sections 41 extend above the height of the platform 20, so does the outer wall where the four support members 51 are formed. The outer support wall 50 is curved inwardly where extends from the base 30 to the platform 20. Similarly, portions of the outer support wall 50 that form the support members 51 are arcuate and/or substantially accurate in shape.

The outer support wall 50 is continuous is as it extends around the base 30 and joins to both the inner wall and platform 20. As the outer support wall 50 is continuous, any load that is borne by the inner wall or the platform 20 is more evenly distributed through the outer support wall 50 to the base 30. This allows for the underside of the support members 51 to be hollow. Strengthening members 70 are located on the underside of the support members 51 on the outer support wall 50.

The post recess 60 is located within the centre of the platform 20 for supporting posts. The post recess 60 includes a series of post ribs 62 which are used to contact a post. The post ribs 62 are connected to the floor 61 and are tapered with the widest portion of the post ribs 62 being located adjacent the floor 61. As the post ribs 62 are tapered, the posts that can be inserted into the post recess 60 can vary in size. The post recess 60 can accommodate square posts with a side length of 88 mm-102 mm (4×4 post).

The floor 61 has a series of strengthening members 70 on its underside to increase the rigidity of the floor 61. The floor 61 of the post recess 60 is planar with the height of the floor 61 is being substantially the same height as the base 30. That is, the floor 61 is in alignment with and lies in the same plane as the base 30. A series of struts 71 connect the post recess 60 and the outer support wall 50 to support the post recess 60. Accordingly, when a post is being supported by the post recess 60, the load carried by the post recess 60 is distributed through both the floor 61 and the base 30 via the outer supporting wall.

Figure 6:
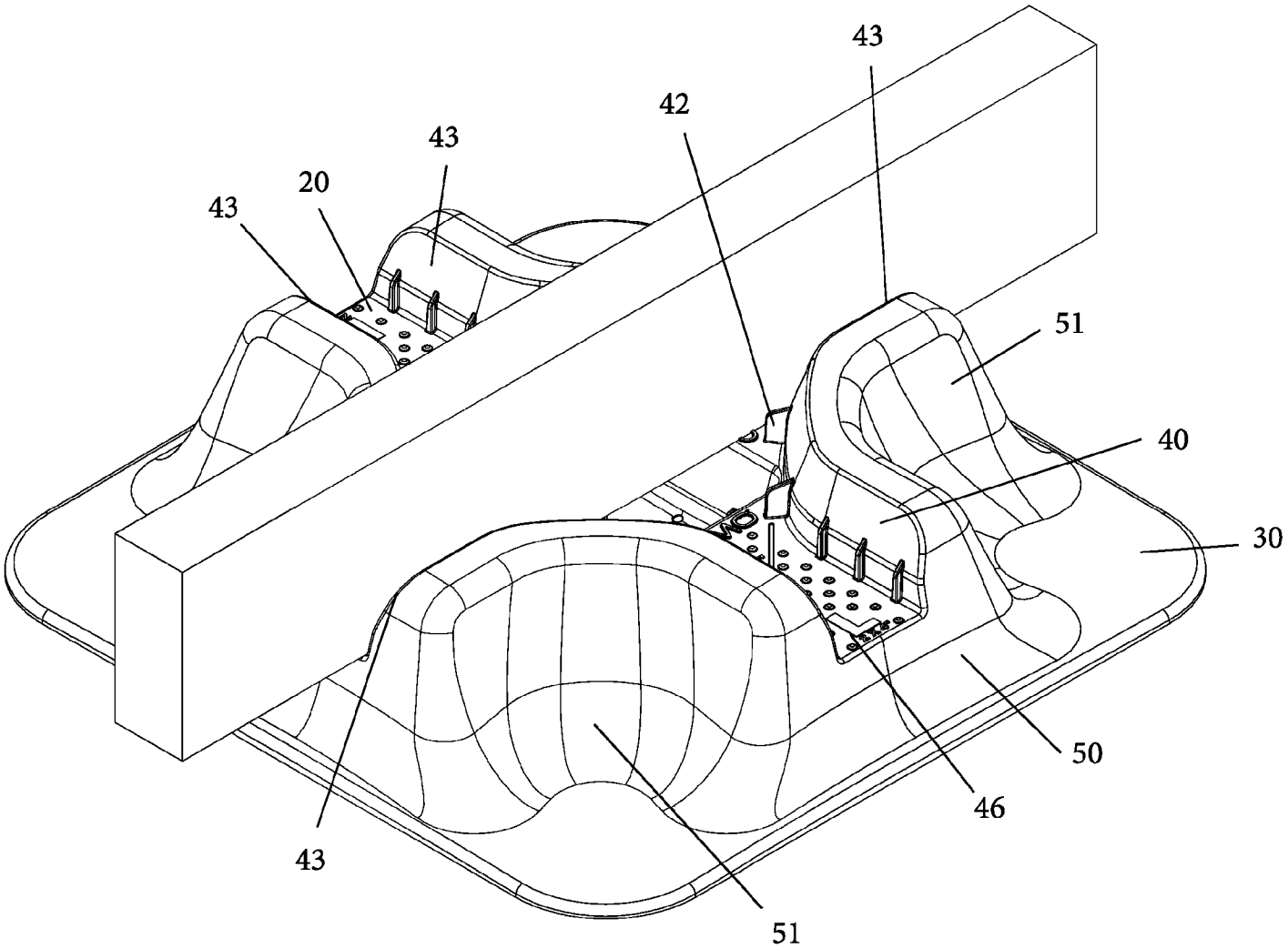
FIG. 6 is a perspective view of the foundation device as shown in FIG. 1 in use supporting a beam on the platform.
Figure 7:
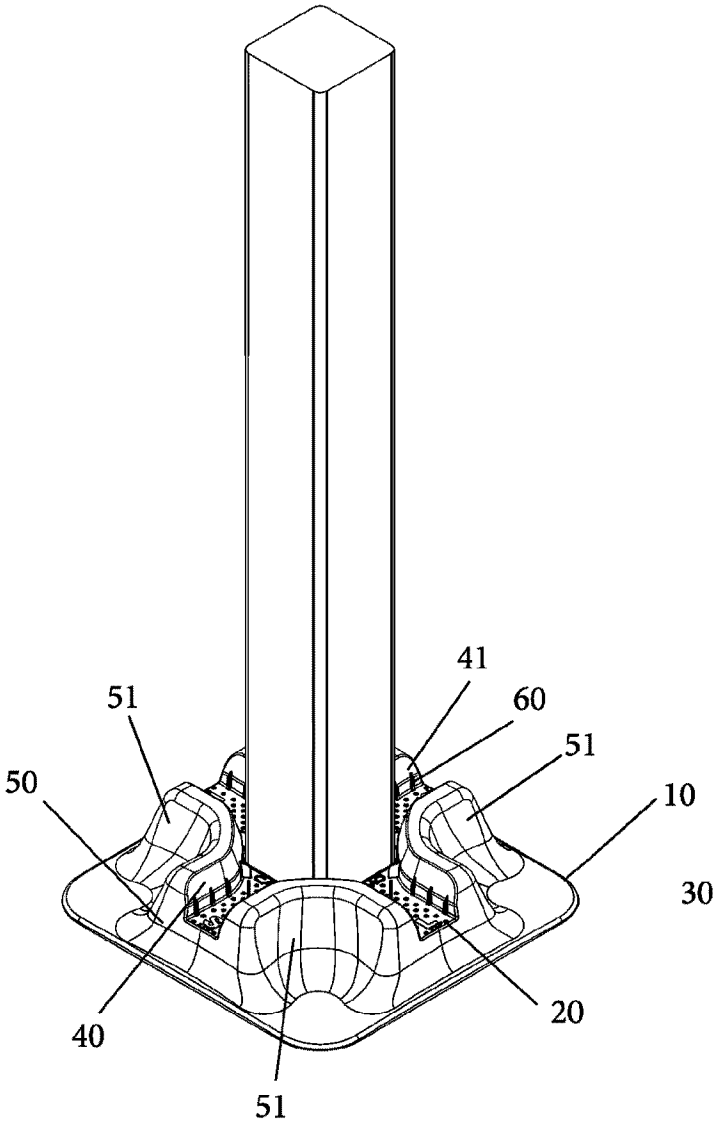
FIG. 7 is a perspective view of the foundation device as shown in FIG. 1 in use supporting a post within the post recess.
Figure 8:
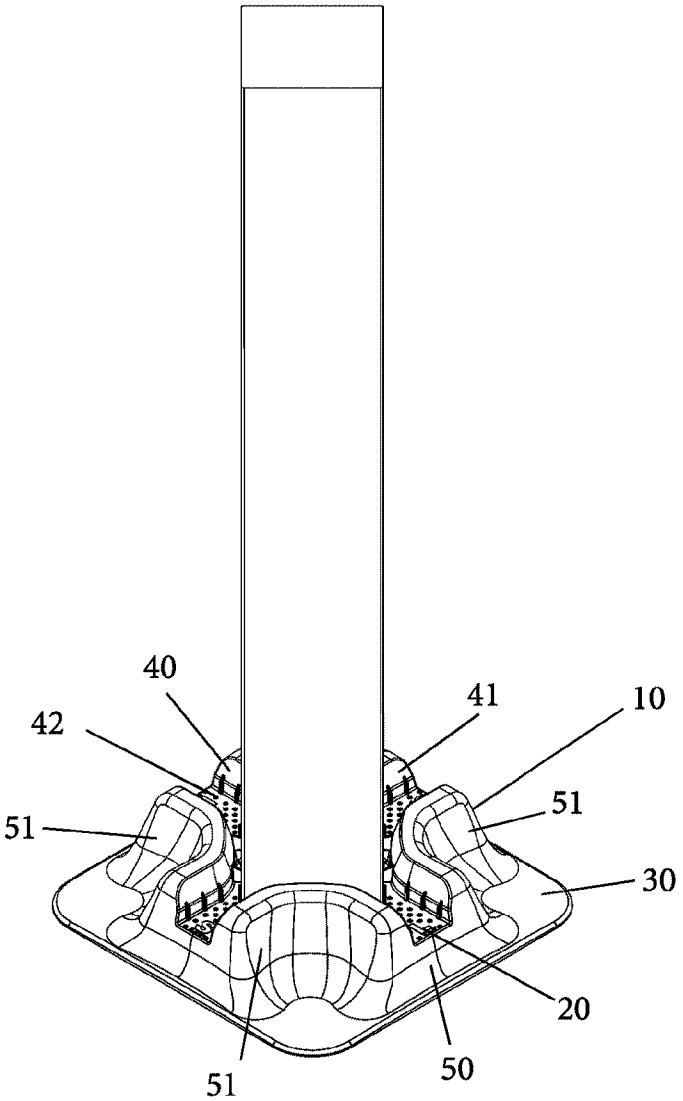
FIG. 8 is a perspective view of the foundation device as shown in FIG. 1 in use supporting a post on the platform.

In use, the foundation device 10 can be used to support beams, as shown in FIG. 6 or support posts of different sizes, as shown in FIG. 7 and FIG. 8.

To support a beam, such as a joist or a bearer, the beam is placed within the first beam channel 45, as shown in FIG. 6. The beam is pushed downwardly toward the platform 20 with the supports ribs engaging the beam. When the beam contacts the platform 20 the beam is held firmly in place. It should be noted that the support ribs 42 on the curve portion of the inner support wall 40 sections are located outside of the first beam channel 45 and the second beam channel 46. That is, the support ribs 42 are located are outside of a plane that aligns with the straight portions 43 of adjacent inner support wall sections 41. Hence, these support ribs 42 on the curved portion of the inner support wall 40 sections do not contact the beam.

If the beam is too large to fit within the first beam channel 45, the foundation device 10 can be rotated through 90 degrees to allow the beam to be placed within the second beam channel 46. This is due to the second beam channel 46 having a greater width than the first beam channel 45. Again, the beam is pushed downwardly toward the platform 20 with the supports ribs engaging the beam. When the beam contacts the platform 20 the beam is held firmly in place.

To support a large square post, typically with a size range of 140 mm-154 mm of a side wall (6×6 post), the post is oriented in accordance with the indicia located on the platform 20, as shown in FIG. 7. The post is pushed downwardly and engages the support ribs 42 located on the curved portions 44 of the inner support wall 40 sections. The post is pushed downwardly until the post contacts the platform 20.

To support a small square post, the post is oriented so it will fit within the post recess 60, as shown in FIG. 8. The post is then inserted into the post recess 60 with the post engaging the post ribs 62. The post is pushed downwardly until the post contacts the floor 61 of the post recess 60.

Figure 9:
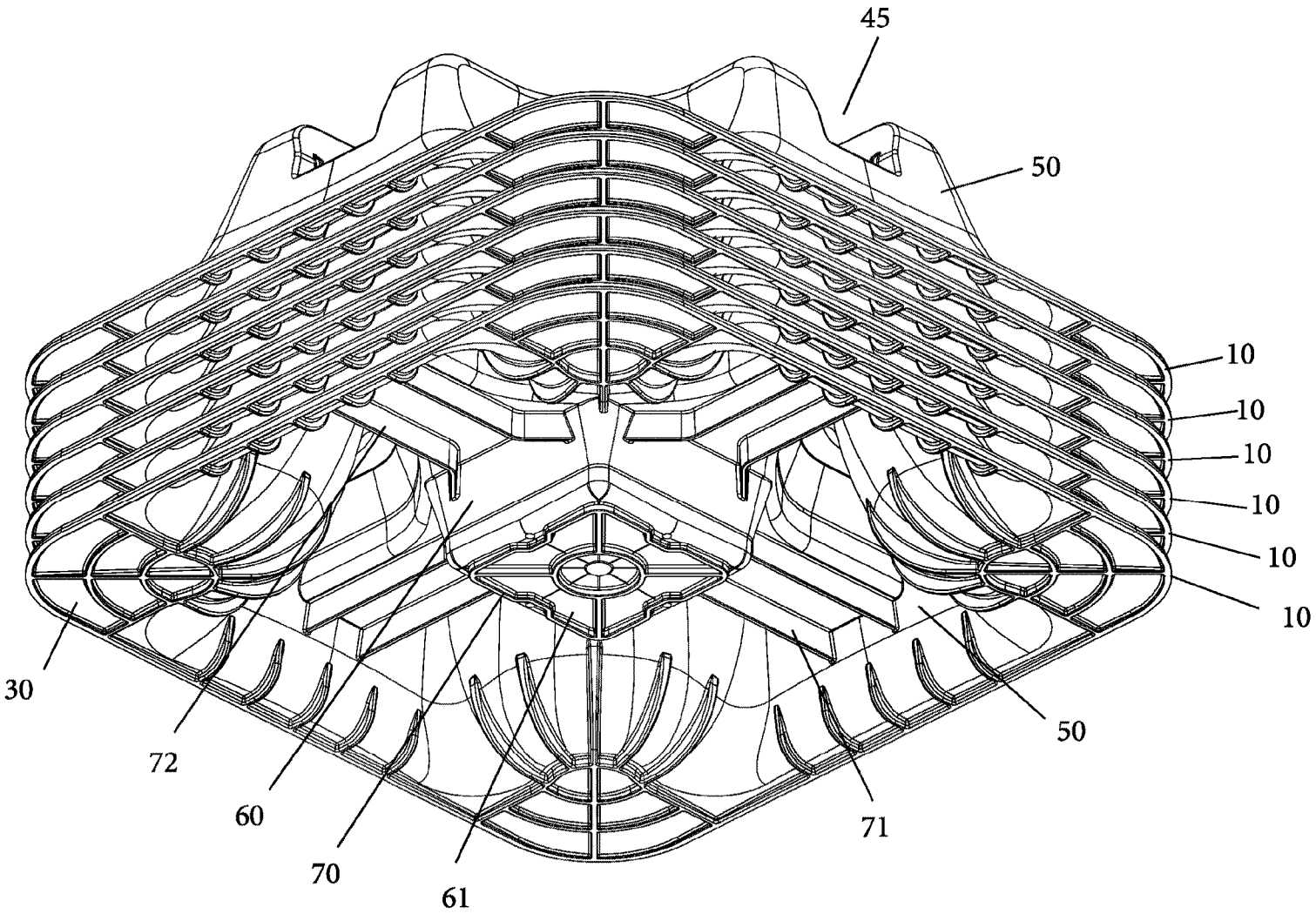
FIG. 9 perspective view a series of foundation devices, as shown in FIG. 1, nested together.

FIG. 9 shows a series of foundation devices 10 that are nested together. A stack height of multiple foundation devices 10 of the current invention is substantially lower than the stack height of the foundation device 10 disclosed in Australian Patent No. 2014203401. This is largely due to the continuous outer support wall 50 providing better force distribution which in turn allows the support members 51 to be hollow to allow better nestability.

Figure 10:
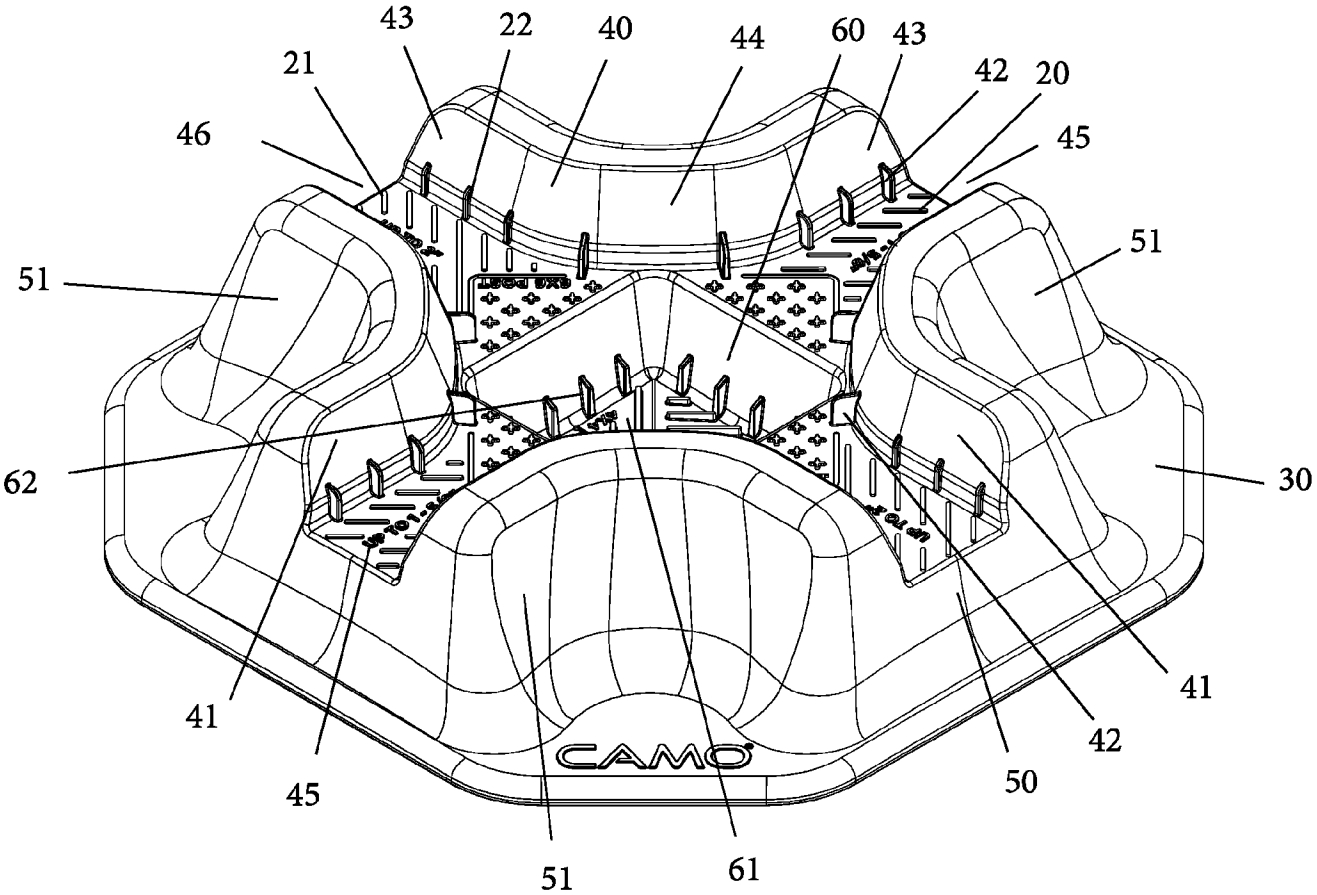
FIG. 10 is a top perspective view of a foundation device according to a second embodiment of the invention.
Figure 11:
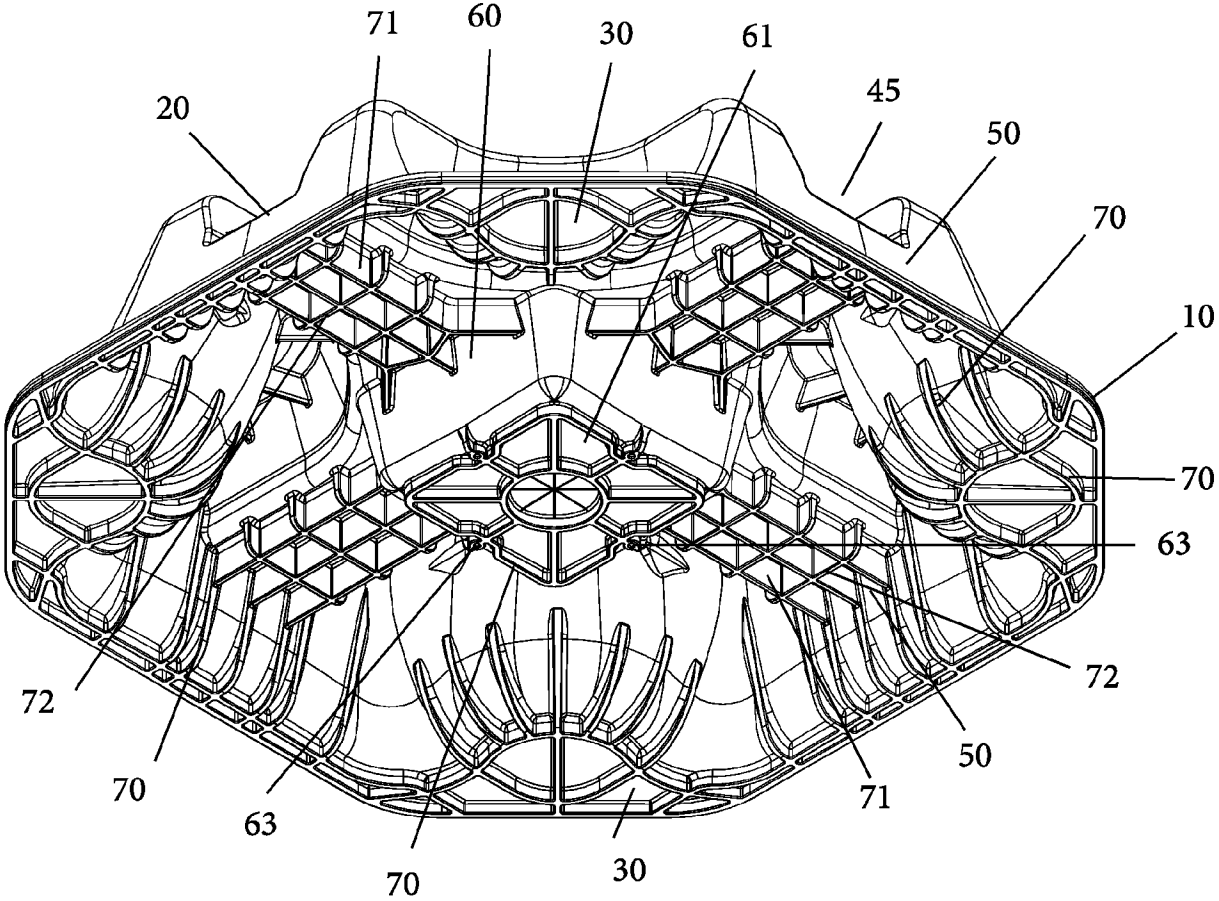
FIG. 11 is an underside perspective view of the foundation device as shown in FIG. 10.

FIGS. 10 and 11 show a second embodiment of the a foundation device 10. Like numerals have been used to described like components from the first embodiment of the foundation device 10. In this embodiment, additional post ribs 62 are located within the post recess 60. Large drainage holes 63 are located within the post recess 60 to enable water to be drained from the post recess 60. The number of strengthening members 70 on the underside have increased. Similarly, struts 71 have lateral cross members 72 that join adjacent struts 71 to further increase rigidity.

In this specification, the terms "comprise", "comprises", "comprising" or similar terms are intended to mean a non-exclusive inclusion, such that a system, method or apparatus that comprises a list of elements does not include those elements solely, but may well include other elements not listed.

The reference to any prior art in this specification is not, and should not be taken as, an acknowledgement or any form of suggestion that the prior art forms part of the common general knowledge.

It should be appreciated that various other changes and modifications may be made to the embodiments described without departing from the spirit or scope of the invention.

The invention claimed is:

1. A foundation device able to support two different sized posts, the foundation device comprising:

a platform;

a base located below the platform, the base connected to the platform by an outer support wall;

an inner support wall extending upwardly from the platform, the inner support wall being separated into four inner support wall sections that define a first beam channel and a second beam channel; and a post recess centrally located within the platform, a floor of the post recess being located lower than that of the platform; wherein the outer support wall extends continuously around the platform and is connected to edges of the platform;

the outer support wall also connected to the inner support wall sections to form support members therebetween, an underside of the support members being hollow to form a nesting cavity and being reinforced by strengthening members.

2. The foundation device of claim 1, wherein the platform is cruciate in shape when viewed in plan.

3. The foundation device of claim 1, wherein the platform includes a series of raised projections located on its surface.

4. The foundation device of claim 1, wherein the inner wall sections include a series of support ribs.

5. The foundation device of claim 4, wherein the support ribs are connected to the platform.

6. The foundation device of claim 4, wherein the support ribs are tapered with a widest portion of the support ribs being located adjacent the platform.

7. The foundation device of claim 1, wherein each of the inner support wall sections include two straight portions that are interconnected by a curved portion.

8. The foundation device of claim 1, wherein a straight portion of one wall section lies in the same plane as a straight portion of an adjacent wall section.

9. The foundation device claim 1, wherein the first beam channel and the second beam channel are transverse with respect to each other.

10. The foundation device of claim 1, wherein the first beam channel and the second beam channel are at substantially right angles with respect to each other.

11. The foundation device of claim 1, wherein the first beam channel and the second beam channel are of a different width.

12. The foundation device of claim 1, wherein the outer support wall is connected to the edges of the platform, the edges of the platform being located adjacent the ends of the first beam channel and the second beam channel.

13. The foundation device of claim 1, wherein portions of the outer walls forming the support members are substantially arcuate in shape.

14. The foundation device of claim 1, wherein the post recess includes a series of post ribs which are used to support a post.

15. The foundation device of claim 1, wherein the height of the floor is substantially the same height as the base.

16. The foundation device of claim 1, wherein a series of the strengthening members form part of an underside of the base, an underside of the outer support wall and/or an underside of the post recess.

* * * * *